US006994032B2

(12) United States Patent
Conley et al.

(10) Patent No.: US 6,994,032 B2
(45) Date of Patent: Feb. 7, 2006

(54) EXPANDABLE TABLE

(75) Inventors: James R. Conley, Hickory, NC (US); Andrew D Rudisill, Hickory, NC (US)

(73) Assignee: Century Furniture, LLC., Hickory, NC (US)

( * ) Notice: Subject to any disclaimer, the term of this patent is extended or adjusted under 35 U.S.C. 154(b) by 379 days.

(21) Appl. No.: 10/403,507

(22) Filed: Apr. 1, 2003

(65) Prior Publication Data

US 2004/0194672 A1 Oct. 7, 2004

(51) Int. Cl.
*A47B 1/00* (2006.01)

(52) U.S. Cl. ..... 108/65; 108/67

(58) Field of Classification Search ..... 108/65, 108/66, 67, 68, 115
See application file for complete search history.

(56) References Cited

U.S. PATENT DOCUMENTS

| | | | | |
|---|---|---|---|---|
| 254,388 A | | 2/1882 | Schultz | |
| 340,176 A | | 4/1886 | Wardwell, Jr. | |
| 351,101 A | | 10/1886 | Fauber | |
| 838,671 A | | 12/1906 | Turner | |
| 1,384,925 A | | 7/1921 | Seiler | |
| 1,993,787 A | * | 3/1935 | Howe | 108/77 |
| 3,683,825 A | * | 8/1972 | Sheldon | 108/66 |
| 4,782,764 A | * | 11/1988 | Robinson | 108/90 |
| 4,809,619 A | | 3/1989 | Piretti | |
| 5,156,095 A | | 10/1992 | Hansbaek et al. | |
| 5,237,937 A | | 8/1993 | Peltier et al. | |
| 5,425,313 A | | 6/1995 | Rowan | |
| 5,458,070 A | | 10/1995 | Gamba et al. | |
| 6,009,814 A | | 1/2000 | Rossi | |

FOREIGN PATENT DOCUMENTS

| | | |
|---|---|---|
| GB | 6788 | 0/1835 |

* cited by examiner

*Primary Examiner*—José V. Chen
(74) *Attorney, Agent, or Firm*—Venable LLP; Henry J. Daley

(57) ABSTRACT

An expanding table of the type in which a number of table top sections are caused to move outwardly and expand on rotation of the table top. The table top sections are coupled to a guide plate, which defines the positions between which the sections move. The guide plate is mounted for rotation and engages low friction rub blocks mounted along the inner perimeter of the outer edge of the table. The table top sections themselves are mounted on guides, which are at least partially received in the guide plate. Once the table top sections have been moved into the expanded configuration by rotation of the table top, table leaves are inserted in the spaces between adjacent table top sections to form a larger contiguous table surface.

49 Claims, 12 Drawing Sheets

EXPANDABLE TABLE

BACKGROUND

1. Field of the Invention

The present invention relates to furniture, and more particularly, to expanding tables.

2. Discussion of Related Art

In 1835, Robert Jupe was granted British Patent No. 6788 for an expanding table. The original Jupe expanding table includes a table top that is divided into a number of sections. Each section is connected to an underlying frame structure, such that when the table top is rotated, the sections move radially outward, increasing the effective size of the table top. Once the table top has been rotated to move the table top sections outward, leaves are inserted between the sections, so as to fill in the spaces created by the outward movement of the sections. Because the table top sections diverge and move radially outward from a central point, the Jupe table top retains its shape in its expanded configuration.

The Jupe table has now become one of the most valuable and sought after antiques. Original Jupe tables in good condition may sell for up to $350,000 at the time of writing. However, despite its popularity, the Jupe table has been very difficult to mass produce, because its workings are both extremely complex and entirely handcrafted.

For example, the frame structure that supports the table top sections in the Jupe table is comprised of many individual beam structures that are secured together to form the frame. Each of those beams must be individually made and assembled to exacting tolerances in order to ensure that the table top sections will move freely and mate in the center of the table top to form a substantially contiguous table surface in both the contracted and expanded configurations. The manufacture of such a structure is time-consuming and is not conducive to rapid production.

Other aspects of the Jupe table design also make the design difficult to implement. For example, in at least some of the existing examples of functioning Jupe tables, the pivot for the table top is a threaded rod that runs the entire length of the table pedestal. That is an extremely difficult and time-consuming configuration to replicate.

Additionally, each table top section in a Jupe table includes a hand carved tenon structure which is received by a central piece that has correspondingly hand carved mortise structures. The central piece locks the table top sections in place relative to one another when the table is in its unexpanded configuration, but minor misalignments in the carving of these can result in the table top sections being unable to engage the central piece to form a contiguous table surface.

In general, even when hand made to the appropriate tolerances and correctly assembled, Jupe tables are especially susceptible to the effects of friction and wear. They require careful handling and frequent maintenance to ensure smooth movement.

SUMMARY OF THE INVENTION

One aspect of the invention relates to an expanding table of the type in which a plurality of table top sections move outwardly upon rotation of the table top to expand the table. The table comprises a pedestal, a guide plate mounted on the pedestal, and a table top coupled to a top surface of the guide plate. The table top comprises a plurality of separate table top sections that are constructed and arranged to be movable relative to each other between positions defined by the guide plate. The table top sections form a substantially contiguous table top when they are in a first position.

A king piece may be mounted on the guide plate. The king piece has receiving structures constructed and arranged to receive projecting structures provided on respective inner edges of the table top sections, so as to form a substantially contiguous table top. In one embodiment, the expanding table is round and the table top sections are shaped as sectors of a circle.

Table leaves may be provided for the expanding table. The table leaves are constructed and arranged to be mounted between respective table top sections so as to form a substantially contiguous table top surface with the table top sections when the table top sections are in a second, expanded position.

The guide plate may include a plurality of guide slots formed in it. A guide may be mounted in each guide slot, and the table top sections may be mounted to the guides. A spline may be mounted within each one of the guide slots to slidingly engage the guide.

Another aspect of the invention relates to an expanding table. The table includes a pedestal and a table top support coupled to the pedestal. Rub blocks are mounted on the table top support. A table top is coupled to a top surface of the guide plate. The table top comprises a plurality of separate table top sections that are constructed and arranged to be movable relative to each other in a radial direction.

The expanding table may include a guide plate engaging the rub blocks with a downwardly-facing surface thereof for rotational movement with respect to the rub blocks.

A king piece may be mounted on the guide plate. The king piece has receiving structures constructed and arranged to receive projecting structures provided on respective inner edges of the table top sections, so as to form a substantially contiguous table top. In one embodiment, the expanding table is round and the table top sections are shaped as sectors of a circle.

Table leaves may be provided for the expanding table. The table leaves are constructed and arranged to be mounted between respective table top sections so as to form a substantially contiguous table top surface with the table top sections when the table top sections are in a second, expanded position.

The guide plate may include a plurality of guide slots formed in it. A guide may be mounted in each guide slot, and the table top sections may be mounted to the guides.

The rub blocks may be comprised of DELRIN® acetal plastic, or they may be comprised of high density polyethylene, ultra high molecular weight polyethylene or ultra ultra high molecular weight polyethylene.

A further aspect of the invention relates to methods for manufacturing the tables described above.

Other features, aspects and advantages will be described in the following detailed description, and in the attached drawings.

BRIEF DESCRIPTION OF THE DRAWINGS

The invention will be described with respect to the following drawings, in which like reference numerals represent like features throughout the figures, and in which.

DETAILED DESCRIPTION

Figure 1:
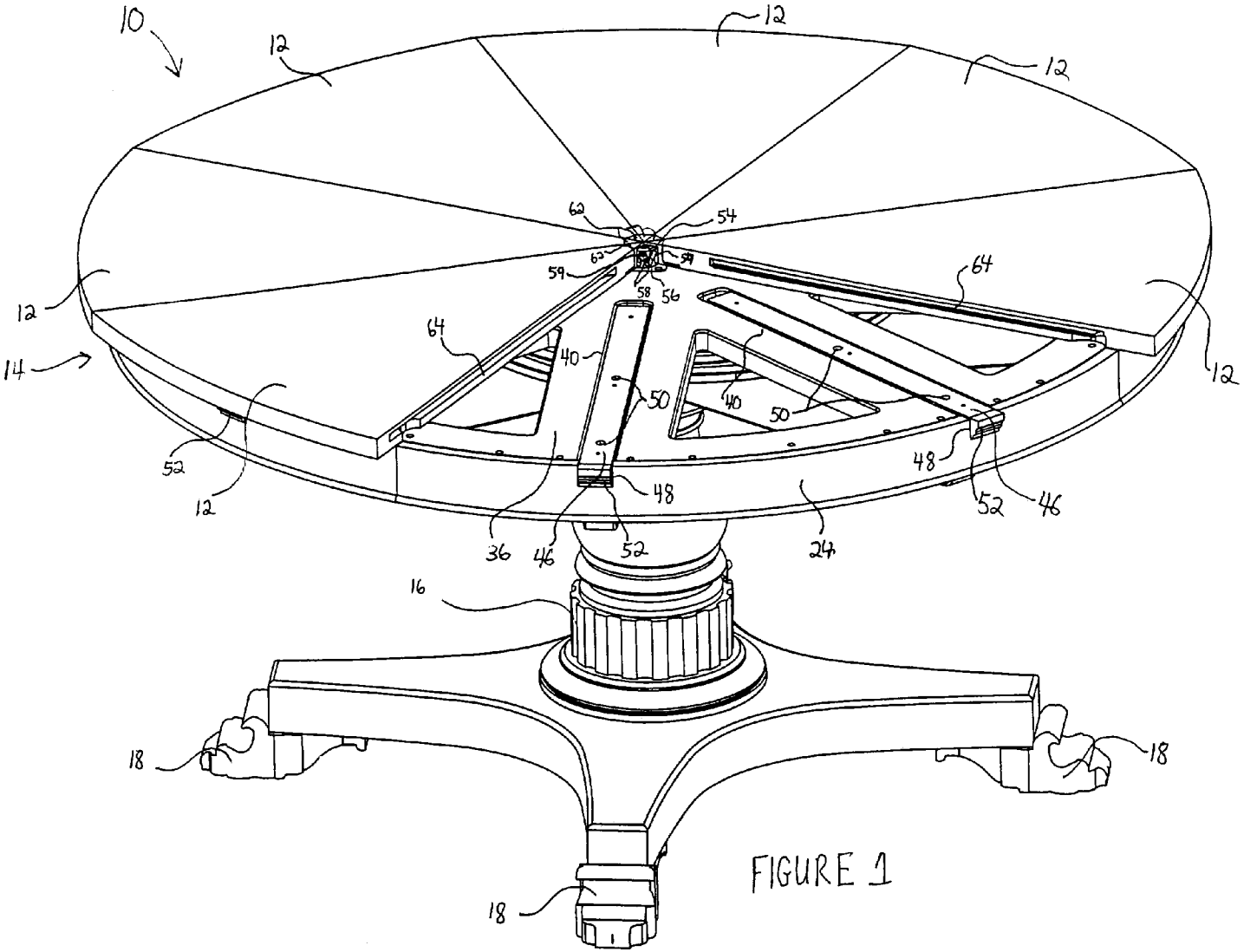
FIG. 1 is a perspective view of a table according to the invention with several of the table top sections removed so as to show the mechanism beneath.

An expanding table according to the invention, generally indicated at 10, is shown in the perspective view of FIG. 1. The table 10 is of the type in which a plurality of table top sections 12 slide outwardly simultaneously in response to a rotation of the table top 14 and outer edge structure 24 so as to expand the effective surface area of the table top 14.

The table top 14 of the table 10 has a generally circular shape, although other shapes, such as oval and rectangular, are contemplated within the scope of the invention, and will be described below with respect to other embodiments. In the view of FIG. 1, the table 10 is in its unexpanded configuration, and two of the table top sections 12 have been removed to illustrate portions of the articulation mechanism of the table 10.

A pedestal 16 supports the table top 14 above floor level at a convenient height, which may be selected as desired. The pedestal 16 is generally vertical in orientation and includes four feet 18 at its base, although various configurations are possible, and any support member that maintains the table top 14 at an appropriate height above floor level may be used. The pedestal 16 may be sculpted or contoured for a decorative effect, as is shown in FIG. 1.

Figure 2A:
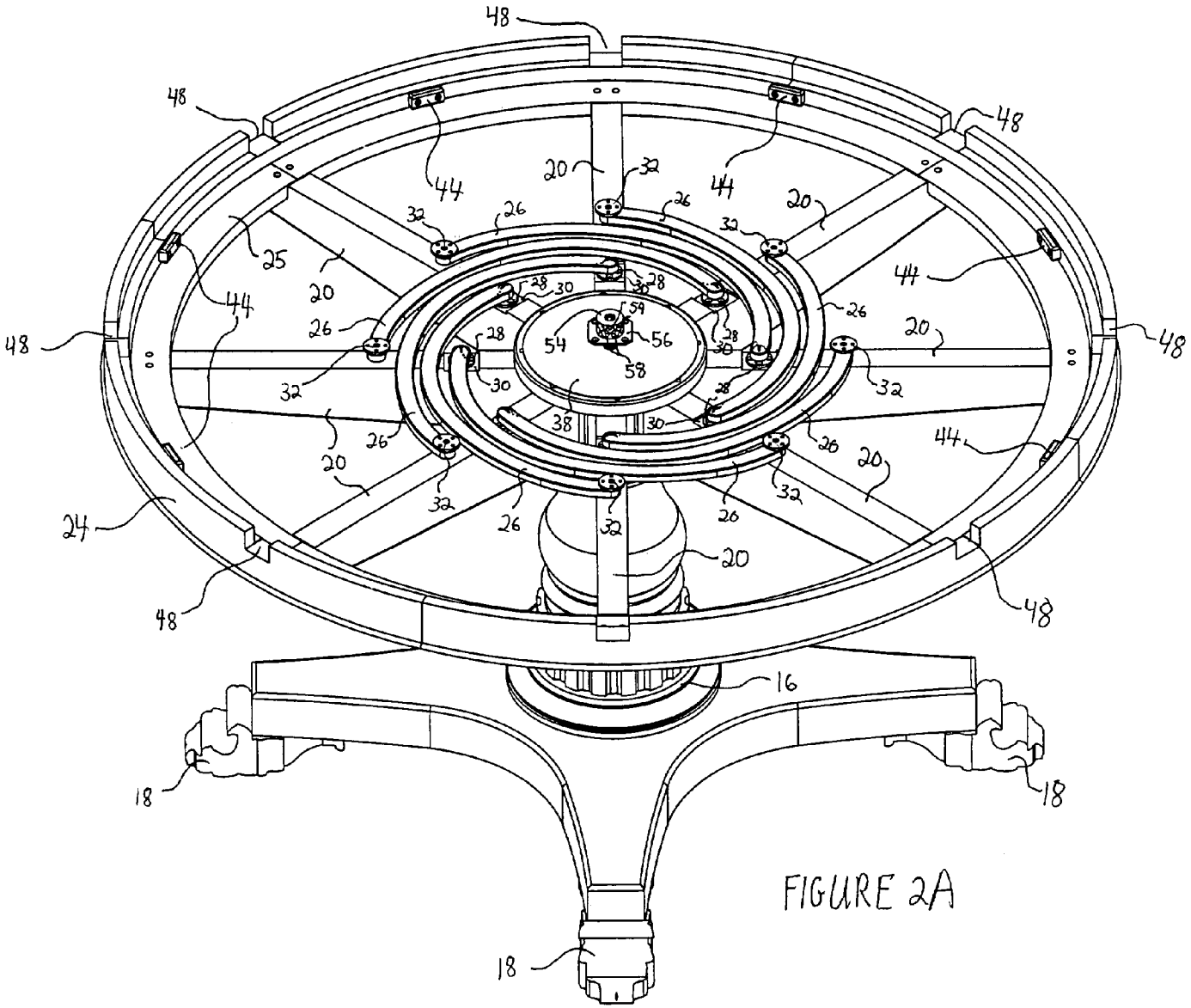
FIGS. 2A and 2B are perspective views of the table of FIG. 1 with the table top sections and guide plate removed, so as to show the table top support structure and the rotating members secured thereto in first and second operative positions, respectively.
Figure 2B:
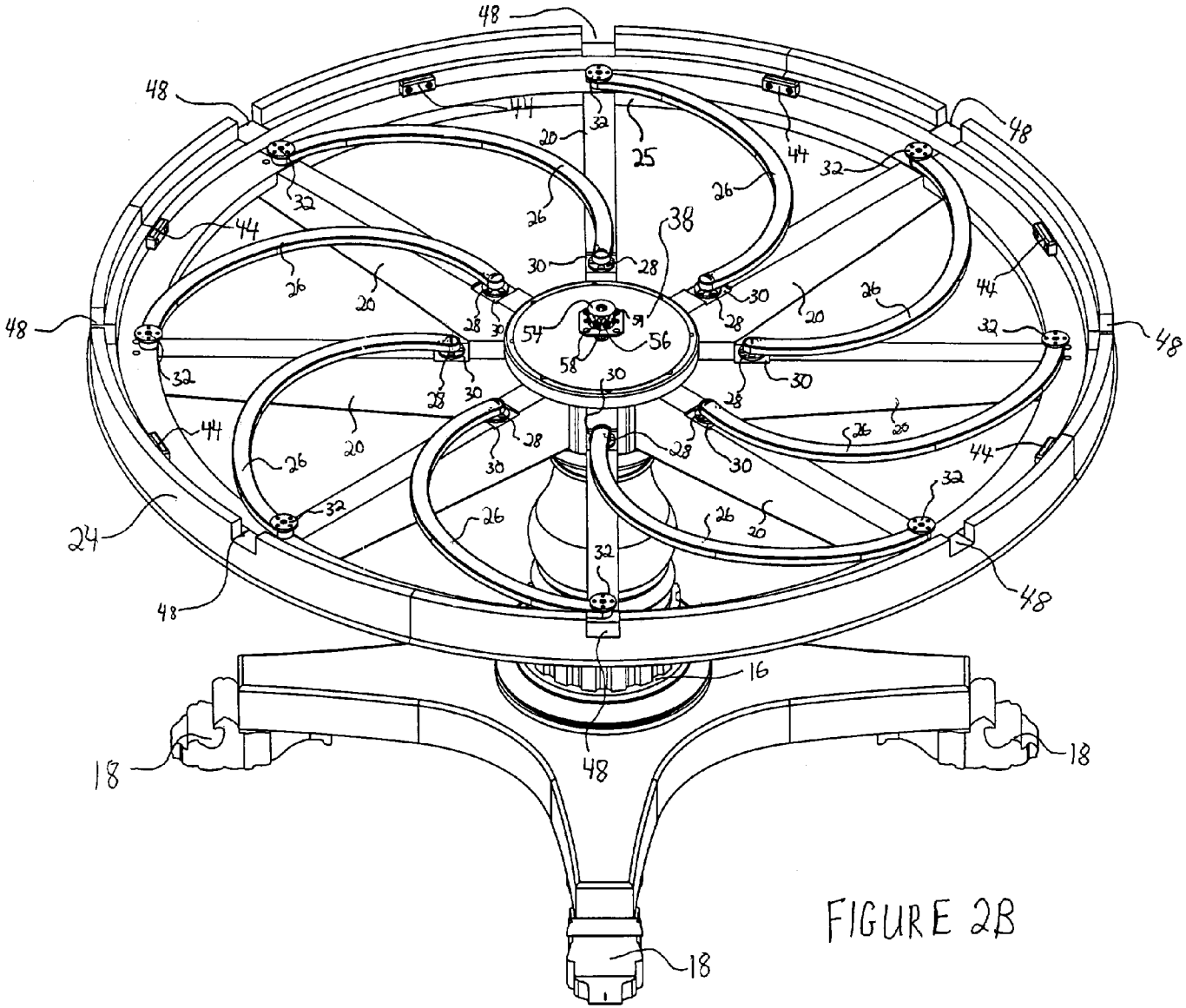
Figure 3:
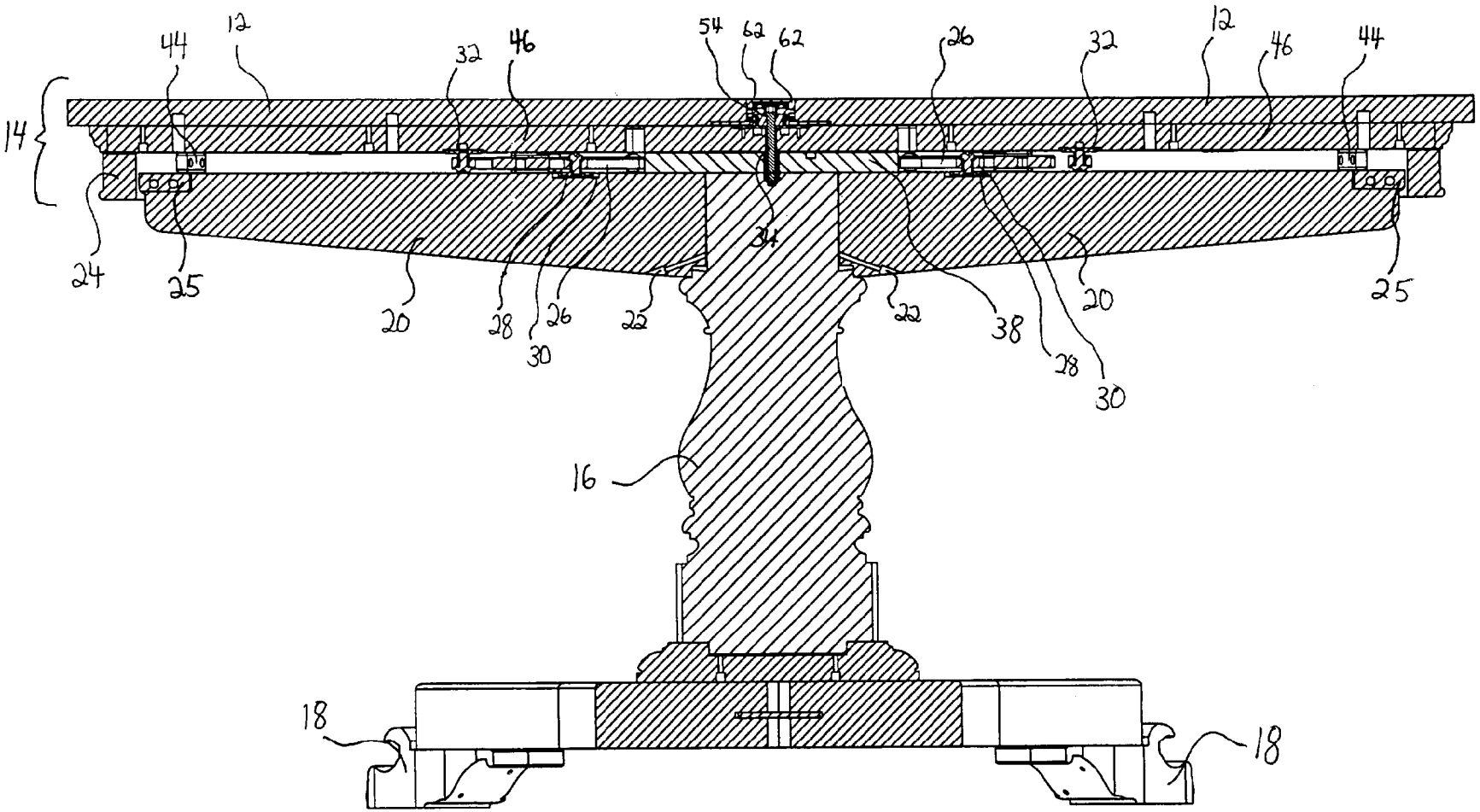
FIG. 3 is a cross-sectional view of the table of FIG. 1.

The construction of the table top 14 can be seen in FIGS. 2A–2B, and in the cross-sectional view of FIG. 3. (In FIGS. 2A and 2B, certain components of the table top 14 are not present in the view, so as to show the remaining components with more clarity, as will be explained below.) As shown in FIGS. 2A–2B and 3, a number of support arms 20 are mounted about the circumference of the pedestal 16 using dovetail joints between the support arms 20 and the pedestal 16. Fasteners (not shown in the Figures) are also secured in a number of holes 22 provided in the support arms 20, primarily to hold the support arms 20 to the pedestal 16 while the dovetail joints are set (for example, with adhesives). Although dovetail joints are used in this exemplary embodiment, any conventional joining process or structure may be used. Eight support arms 20 are provided for the table top 14, although more or less may be provided. The support arms 20 extend generally outwardly from the pedestal 16 and are generally co-planar, so as to provide a relatively level support for the table top 14.

A support rim 25 extends around the circumference of the circle defined by the free ends of the support arms 20 and provides a continuous, fixed contact surface along the free ends of the support arms 20. Outer edge structure 24 rests on the support rim 25 and extends upwardly from it to define the outer edge of the table top 14. The features of the outer edge structure 24 will be described in more detail below.

On an inner portion of each support arm 20, proximate to the pedestal 16, an arcuate rotating member 26 is mounted for rotation about a vertical rotational axis by a downwardly-facing engaging end 28 of the rotating member 26 that is secured within a shallow trough 30 provided in the support arm 20. The downwardly-facing engaging end 28 of the rotating member 26 is mounted in the trough 30 by threaded fasteners and forms a hinged pin joint in the illustrated embodiment, although other mounting configurations could be used. The trough 30 accommodates the height of the mounting hardware used to mount the downwardly-facing engaging end 28 of the rotating member 26, so that the height of the mounted rotating member 26 does not exceed a desired height, such that other components may be mounted on the rotating members 26 without exceeding the height of the outer edge structure 24.

As mounted on the support members 20, the arcuate rotating members 26 may rotate between "closed" positions, in which the free, upwardly-facing ends 32 of the rotating members 26 are proximate to the pedestal 16, and "open" or "expanded" positions, in which the free, upwardly-facing ends 32 of the rotating members 26 are proximate to the outer edge structure 24. FIG. 2A illustrates the "closed" positions of the rotating members 26, and FIG. 2B illustrates the "open" or "expanded" positions of the rotating members 26.

The rotating members 26 may have several different radii of curvature along their lengths. The precise radii of curvature used in the rotating members 26 may be readily determined by those skilled in kinematics, given the desired initial and final positions of the rotating members 26. The use of several radii of curvature along the length of the rotating members 26 permits one to manufacture the rotating members 26 sufficiently precisely and economically. However, continuously varying, smoothly curved rotating members are also within the scope of this invention.

As shown in the cross-sectional view of FIG. 3, a threaded rod 34 is fixedly mounted within an upper portion of the pedestal 16 such that it extends upwardly from the pedestal 16 and acts as a central rotational axis for the table top 14. Rotatably mounted over the threaded rod 34 and on the pedestal 16 is a guide plate 36. The guide plate 36 is partially visible in FIG. 1, but is not shown in FIGS. 2A and 2B; it is best shown in the perspective views of FIGS. 4 and 6.

The guide plate 36 is a generally circular plate that has a number of linear slots 40 formed in it. Although the guide plate 36 is circular in this embodiment, it is generally not limited to only circular shapes. The linear slots 40 extend from an inner central portion of the guide plate 36 radially outward toward the edge of the guide plate 36. The number of linear slots 40 corresponds to the number of rotating members 26 provided in the table 10. Each linear slot 40 is sized and adapted to at least partially receive a free, upwardly-facing end 32 of one of the rotating members 26 so as to engage the free, upwardly-facing end 32 for sliding movement within the linear slot 40. The linear slots 40 are sized so that the positions of the ends of the slots 40 that are proximate to the pedestal 16 correspond to the positions of the free, upwardly-facing ends 32 of the rotating members 26 when they are in the "closed" position illustrated in FIG. 2A.

By receiving the free, upwardly-facing end 32 of each rotating member 26 in a slot 40, the guide plate 36 constrains all of the rotating members 26 to move substantially simultaneously and coincidentally such that their upwardly facing ends 32 move between the ends of the linear slots 40. (The upwardly-facing ends 32 have the same type of hinged pin joint as the downwardly-facing ends 28, although the joints or mounting strictures of the two ends 28, 32 may be different in different embodiments.) In general, the arrangement is such that a rotational movement of the guide plate 36 is translated into a radially inward or outward movement of the upwardly facing ends 32 of the rotating members 26.

The guide plate 36 illustrated in the Figures also includes open sections 42 from which the material has been cut out or otherwise removed. The inclusion of open sections 42 reduces the weight of the guide plate 36 and, therefore, makes it easier for the user to rotate the guide plate 36. In the illustrated embodiment, the open sections 42 are generally sector-shaped, such that the guide plate 36 as a whole has a "hub-and-spoke" configuration. However, those of ordinary skill in the art will realize that the inclusion of open sections 42 is optional, and that, if provided, the open sections 42 may have substantially any shape. In the guide plate 36, enough material (e.g., wood) remains between the open sections 42 and the linear slots 40 so that the mechanical strength required by the linear slots 40 is not compromised.

Whereas the original Jupe rotating table design used a frame comprised of multiple precision-crafted parts to guide the movements of the table top sections, a single piece guide plate, such as guide plate 36, is easier to manufacture and presents less of a consistency and tolerance problem. Additionally, the table 10 is far easier to assemble because of the guide plate 36 than a comparable original Jupe table would be. As was described above, assembly of the frame structure of the Jupe table is a precision, hand-crafted and labor-intensive process.

Towards its center, the guide plate 36 rests on and slides against a center plate 38 that is secured to the pedestal 16. At its outer edge, the guide plate 36 is supported by rub blocks 44 (best shown in FIGS. 2A and 2B) that are secured to the inner perimeter of the outer edge structure 24. A lower face of each rub block 44 is designed to slide against the support rim 25; the upper face of each rub block 44 is designed to rest against the lower surface of the guide plate 36. The rub blocks 44 are designed to support the guide plate 36 and outer edge structure 24 and reduce the friction required to rotate them. The rub blocks 44 are constructed of a low-friction plastic material, such as DELRIN® (acetal polymer sold by DuPont, Inc., Wilmington, Del., United States) or high density polyethylene, although DELRIN® is currently preferred for most applications. In other embodiments, ultra high molecular weight (UHMW) or ultra ultra high molecular weight (UUHMW) polyethylene may be used. In general, the material of the rub blocks 44 should have high stiffness, low coefficient of friction, and resistance to abrasion. It is also desirable for the rub blocks 44 to have chemical resistance, particularly to the types of oils, finishes and lubricants that might be used on the table 10. The number, size, and location of the rub blocks 44 may be selected as desired. However, it is generally desirable to provide enough rub blocks 44 substantially evenly spaced around the perimeter of the table top 14, so as to provide the guide plate 36 with even support. Eight rub blocks 44 are used in the table 10. In tables 10 according to the invention, it is contemplated that the rub blocks 44 may carry much of the weight of the guide plate 36 and outer edge structure 24.

The guide plate 36 is rotatably mounted on the pedestal 16 at its center and received within the outer edge structure 24 such that its lower surface rests on the rub blocks 44 and its top surface is generally flush with the top of the outer edge structure 24. Within each one of the linear slots 40, an elongate guide 46 is mounted (two of the eight guides 46 are shown in FIG. 1). The guides 46 are mounted on the respective upwardly facing ends 32 of the rotating members 26 such that they slide inwardly and outwardly within the linear slots 40 when the guide plate 36 is rotated to move the rotating members 26.

Figure 6:
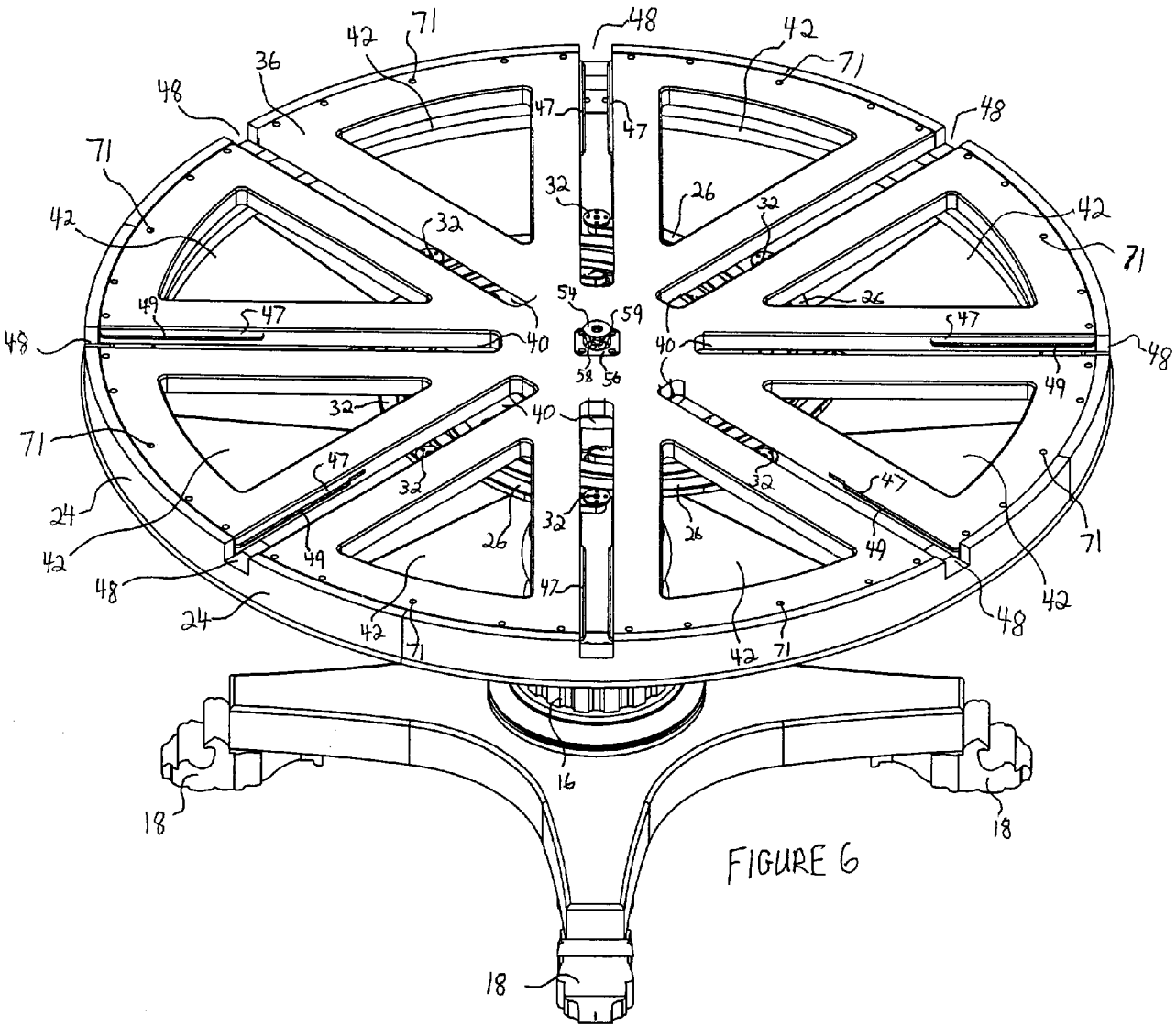
FIG. 6 is a perspective view of the table of FIG. 1 with the table top sections removed.

As shown in FIG. 6, each of the linear slots 40 has a spline 47 mounted within, along the inner periphery of the linear slot 40. The splines 47 are comprised of a graphite and carbon fiber composite material and include tracks 49 formed therein. Alternatively, the splines 47 could be comprised of DELRIN® or one of the polyethylene materials described above. The tracks 49 are designed to slidingly engage projecting structures of the guides 46 (not shown in FIG. 6) so as to mount the respective guides 46 for sliding movement engaging the splines 47 within the linear slots 40.

The guides 46 are positioned relative to the outer edge structure 24 so that they may slide in and out of the slots 48 in the outer edge structure 24 and the linear slots 40 cut in the outer edge structure 24. Because they extend through both the slots 48 and the linear slots 40, the guides 46 also couple the movement of the guide plate 36 and outer edge structure 24 so that the guide plate 36 rotates with the outer edge structure. Each guide 46 provides holes or other receptacles 50 for mounting one of the table top sections 12. The outer ends 52 of the guides 46 may be provided with a decorative appearance, because the outer ends 52 may be visible to the user.

Figure 4:
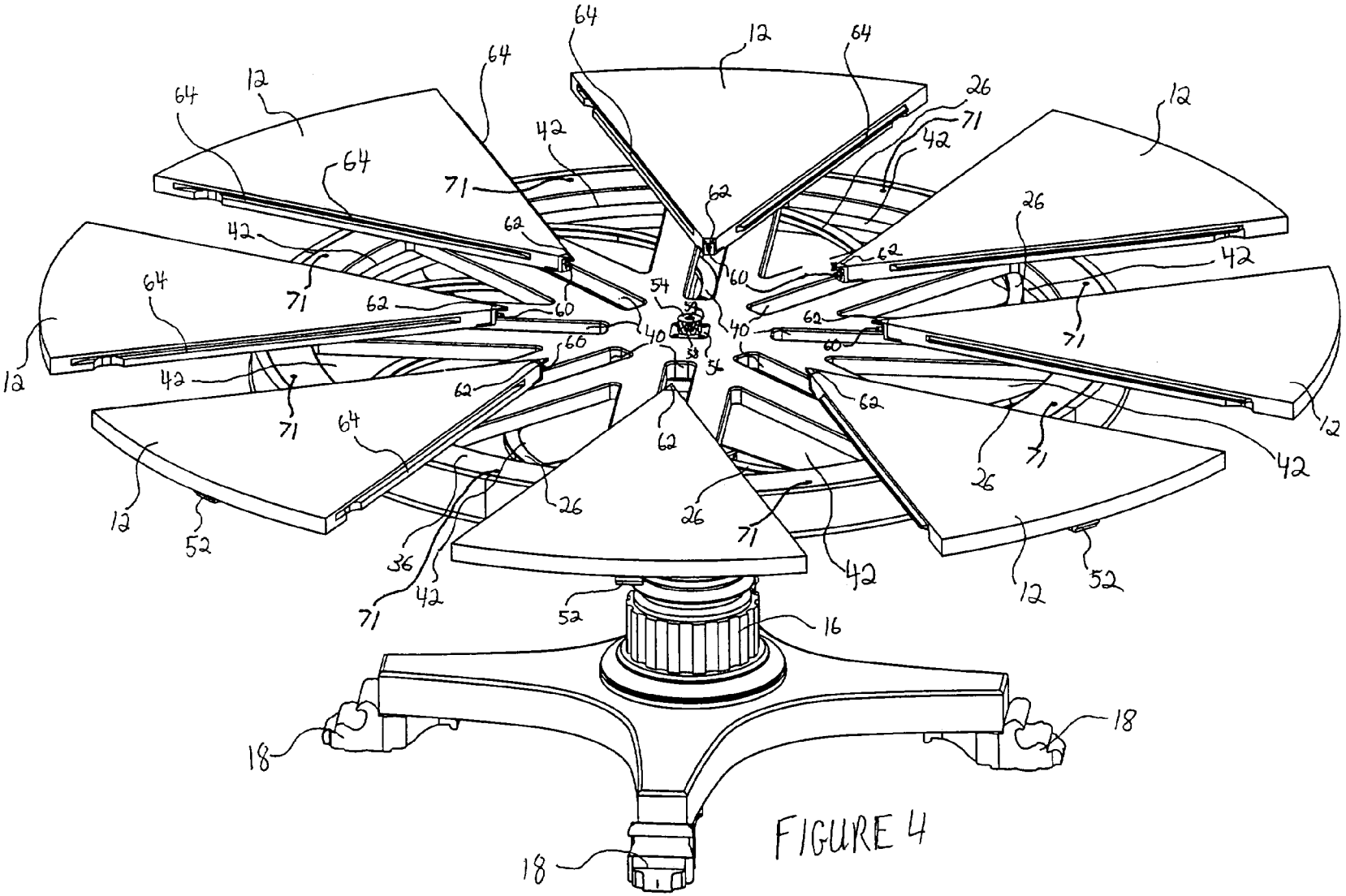
FIG. 4 is a perspective view of the table of FIG. 1 in an expanded configuration without table leaves installed.

One table top section 12 is mounted on each guide 46, the overall arrangement being such that a clockwise rotational movement of the table top 14 (including the outer edge structure 24) causes the rotating members 26 to move outwardly along the linear slots 40 in the guide plate 36, which, in turn, causes the guides 46 and the table top sections 12, which are mounted on the guides 46 to move outwardly. Conversely, a counter-clockwise rotation of the table top 14 causes the rotating members 26 and table top sections 12 to move inwardly. The direction of rotational movement that causes an inward or outward movement may be arbitrarily selected. For example, if the rotating members 26 are arranged in a reverse orientation from that illustrated in the figures, a counter-clockwise movement of the table top 14 may cause the table top sections 12 to move outwardly. FIG. 4 illustrates the expanded position of the table 10, with the table top sections 12 in the outward position.

Figure 7:
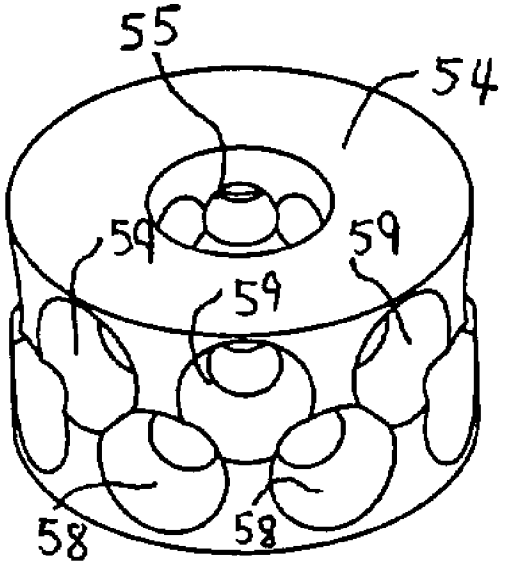
FIG. 7 is a perspective view of a king piece included in the table of FIG. 1.

At the center of the table top 14, where all of the table top sections meet when the table 10 is in the unexpanded configuration, a king piece 54 is mounted on a king plate 56, which, in turn, is mounted to the guide plate 36 so that the king piece 54 and plate 56 rotate with the guide plate 36. FIG. 7 is a perspective view of the king piece 54 in isolation. As shown in FIG. 7, the king piece 54 is generally cylindrical in shape and includes two rows of hole-receptacles, one row of lower hole-receptacles 58 and one row of upper hole-receptacles 59 evenly spaced about its circumference. Each receptacle 58, 59 is sized to receive a projection 60 provided on a bracket 62 that is fastened to the inner edge of each table top section 12 and each table leaf 66. (The table leaves 66 will be described in more detail below.) The hole-receptacles 58, 59 have a generally horizontally-extending funnel shape with sloped wall portions. The funnel shape of the hole-receptacles 58, 59 facilitates the alignment of the hole-receptacle 58, 59 with respect to the projection 60, in that if a minor misalignment occurs during the engagement process, the funnel shape of the hole-receptacle 58, 59 will guide the projection 60 towards the center of the hole-receptacle 58, 59. Similarly, the projection 60 may be provided with a tapered shape, which may assist in the alignment process during mating. At its center, the king piece 54 includes a counterbored hole 55 sized to accommodate the threaded rod 34, which passes through the king plate 56 and secures the king piece 54 and king plate 56 rotatably to the pedestal 16.

Figure 8:
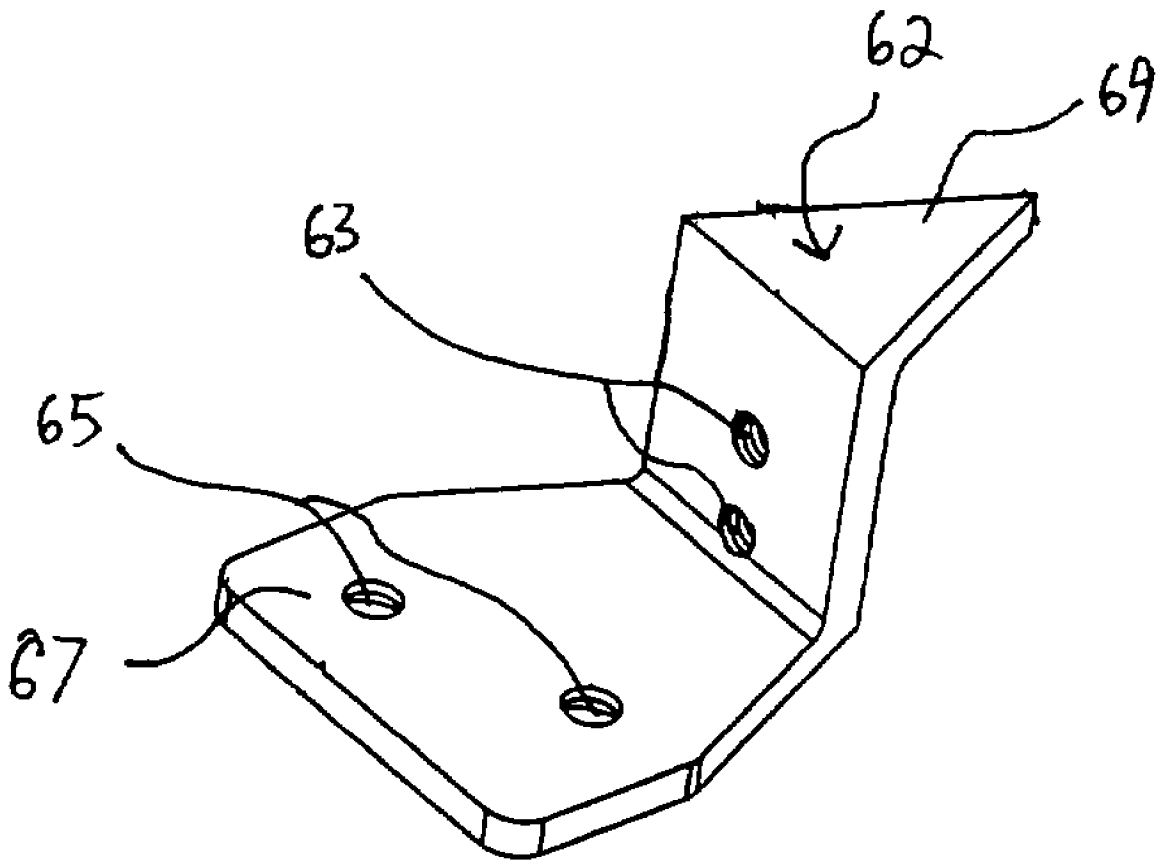
FIG. 8 is a perspective view of a bracket adapted to mate with the king piece of FIG. 7.

FIG. 8 is a rear perspective view of the bracket 62. The bracket 62 is most advantageously designed so that the projection 60 may be removably mounted on the bracket 62 so as to be at the proper height to mate with either of the upper 59 or lower 58 rows of hole-receptacles of the king piece 54. Using that configuration, the same bracket 62 may be used on either a table top section 12 or a table leaf 66 by changing the position of the projection 60. In FIG. 8, two threaded holes 63 are provided in the bracket 62 for engaging a projection 60 that includes a corresponding threaded portion 60 along its length. The threaded holes 63 need not extend through the entirety of the bracket 62, although they do in the embodiment illustrated in FIG. 8. The positions of the threaded holes 63 may be chosen to suit the design dimensions. Other moveable projection configurations are possible. For example, the projection 60 could be moveably secured within a vertically-extending slot in the bracket by an engaging nut or other similar structure.

FIG. 8 also shows the horizontally-extending portion 67 of the bracket 62. Two threaded holes 65 are provided in the horizontally-extending portion 67 so that the horizontally-extending portion 67 of the bracket 62 may be secured to the underside of a table top section 12. Typically, the threaded holes 65 would be bored for pan-head or other such screws that could be made flush with the lower face of the horizontally-extending portion 67.

When the projection 60 has engaged a receptacle 58, 59 in the king piece 54, the table top section 12 or table leaf 66 is "locked" in place with respect to the other table top sections 12. The engagement of the projections 60 and the receptacles 58, 59 "locks" the table top section 12 or table leaf 66 three-dimensionally; that is, the engagement prevents movement in the horizontal as well as vertical planes. The top of the bracket 62 has a triangular edge 69 that projects over the top of the king piece 54 to complete the table top 14.

On each side, each table top section 12 includes a tongue-and-groove structure 64 that is constructed and arranged to mate with the tongue-and-groove structures 64 of adjacent table top sections 12. The king piece 54, king plate 56, and brackets 62 may be made of a metal. If a decorative effect is desired, it may be advantageous to make those components from brass.

Figure 5:
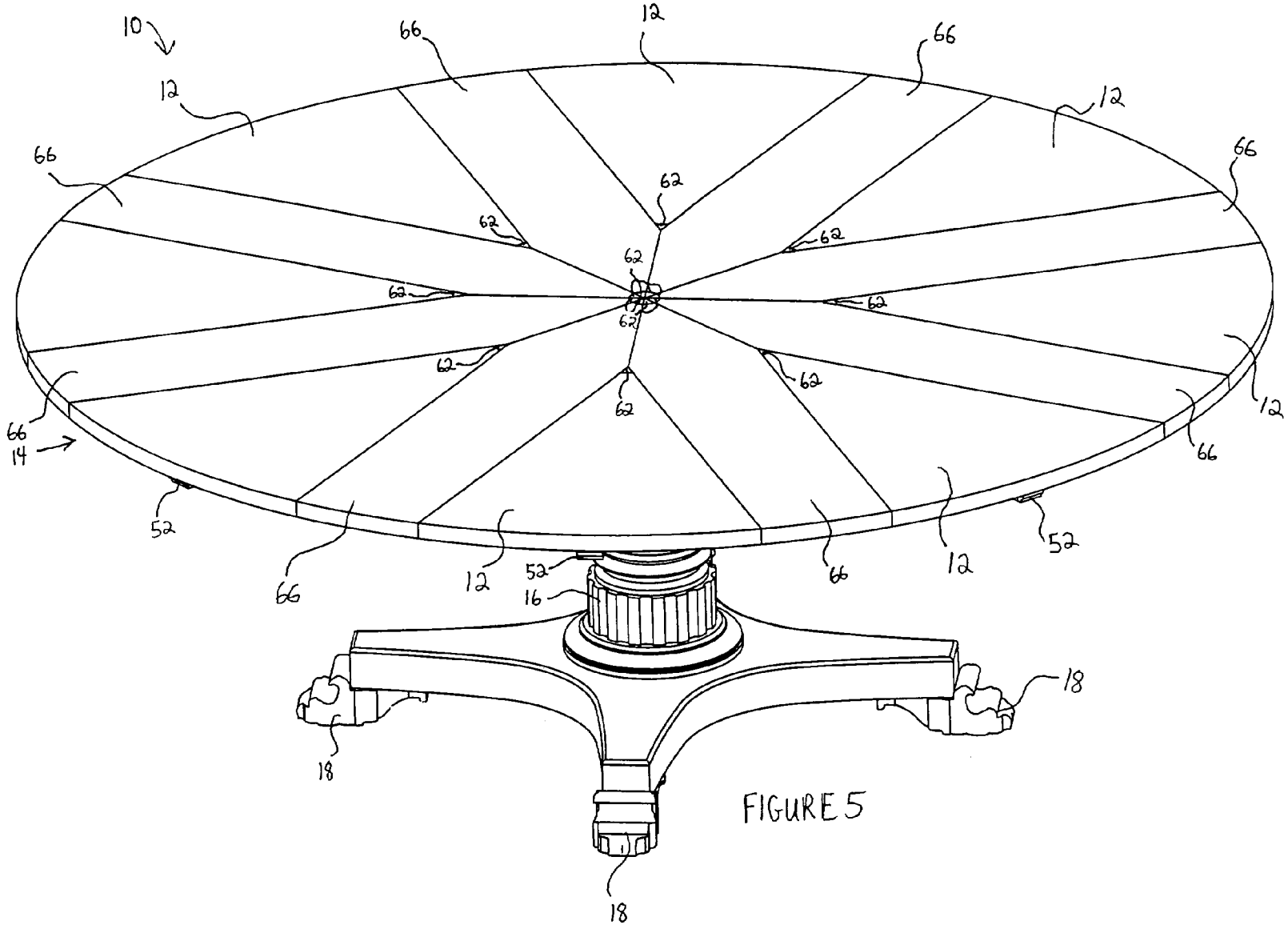
FIG. 5 is a perspective view of the table of FIG. 1 in an expanded configuration with table leaves installed.

As shown in FIG. 4, the expanded configuration of the table top sections 12 leaves substantial room between the sections. In order to fill the space, and to provide a contiguous table top surface in the expanded configuration, a number of table leaves 66 are placed on the guide plate 36. FIG. 5 is a perspective view of the table 10 in its expanded configuration with the table leaves 66 installed on the guide plate 36. Each table leaf 66 has a generally pentagonal shape and includes a bracket 62 on its inner edge for engaging the king piece 54 to lock the table leaf 66 in place with respect to the table top sections 12 that are adjacent to it. The table leaves 66 also include tongue and groove structure (not shown in the Figures) for engaging the complimentary tongue and groove structures 64 of the table top sections.

The projections 60 in the brackets 62 of the table leaves 66 are positioned to engage the lower row of hole-receptacles 58 of the king piece 54. Similarly, the upper row of hole-receptacles 59 of the king piece 54 are positioned and adapted to engage the brackets 62 of the table top sections 12. As shown in FIG. 7, the upper row of hole-receptacles 59 is angularly offset from the position of the lower row of hole-receptacles 58.

In addition to the engagement of the king piece 54 with respective brackets 60, the guide plate 36 provides a number of locating pin holes 71 into which locating pins, such as wooden dowels, may be secured. The locating pins may be used to locate the table leaves 66 relative to the table sections 12, such that the table leaves 66 are located properly and do not slide relative to the guide plate 66 once they have been put into position.

The majority of the components of the table 10, including the pedestal 16, guide plate 36, and table top sections 12 may be constructed of any material. However, wood is one customary and preferred material for tables of this type. Typically, when wood is used as a material for conventional furniture, the dimensional tolerances specified are relatively great. In the case of the table 10, it is advantageous if the dimensional tolerances are kept relatively small, as minor variations in component size may cause friction-inducing misalignments, or may prevent the table top sections 12 from meeting at the king piece 54 to form a substantially contiguous table top surface.

As one example of the type of dimensional tolerances that are beneficial in a table such as table 10, if the table 10 has an overall diameter of about 84 inches in the expanded configuration and a height of about 30 inches, the table top sections 12, support arms 20, guide plate 36, and other wood components may be given dimensional tolerances of ±0.03 inches or less. The metal components, such as the king piece 54 and brackets 62 may be given dimensional tolerances of ±0.004 inches or less.

Typically, the table top sections 12, pedestal 16, and other components visible to the user have a visually attractive surface finish. In particular, if those components are wood, they may be stained and polished to a desired decorative finish.

Figure 9A:
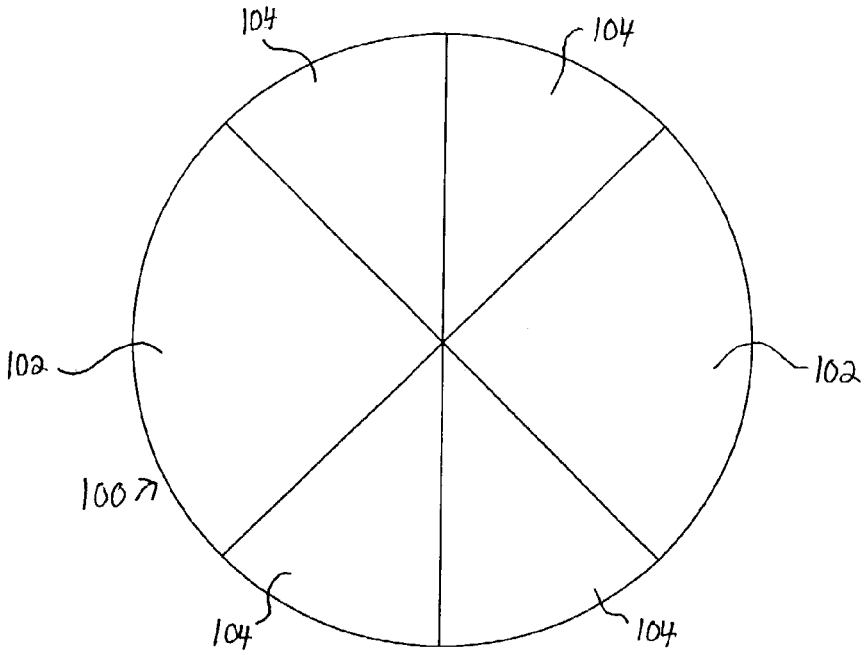
FIGS. 9A and 9B are schematic top plan views of a table according to another embodiment of the invention.
Figure 9B:
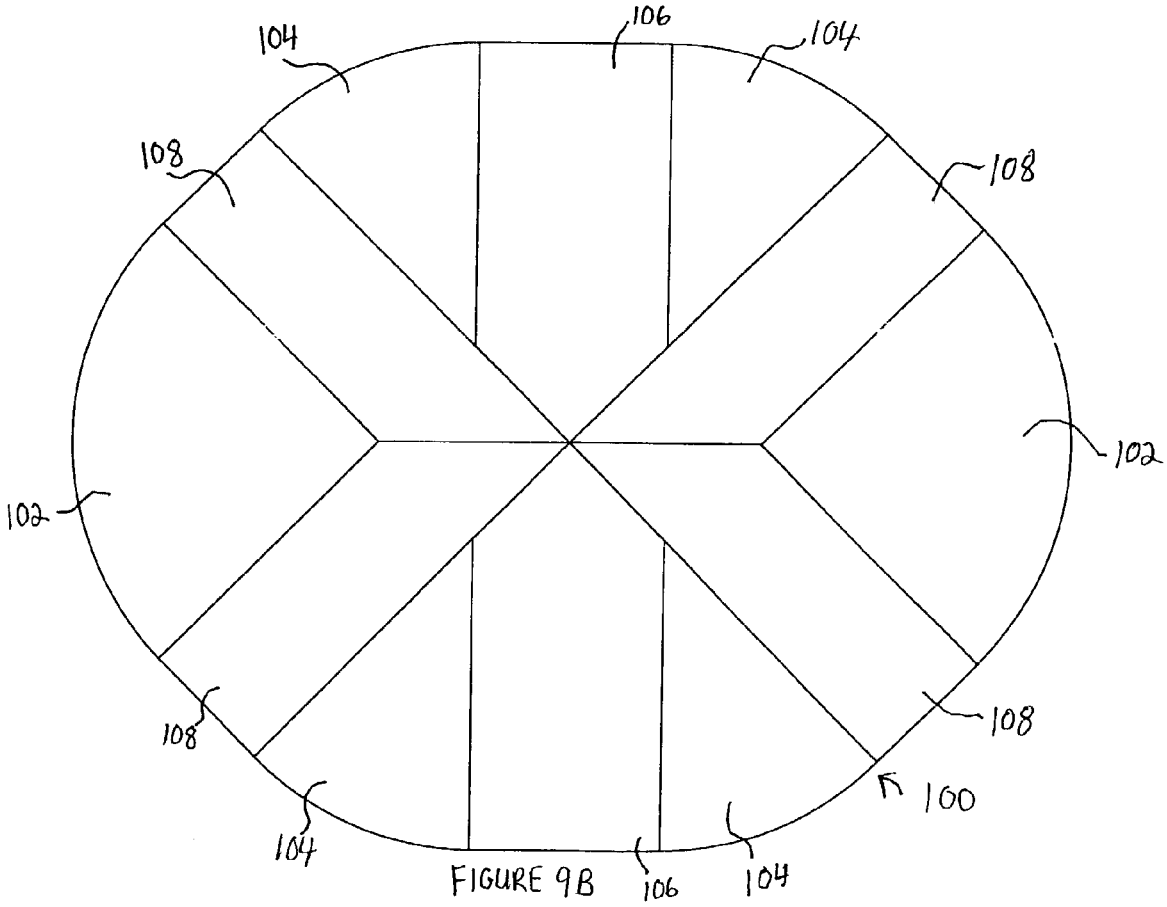

Although the table 10 described above is round and remains round in its expanded configuration, tables of many different shapes and sizes may be made according to the principles of the present invention. For example FIGS. 9A and 9B are schematic top plan views of another table 100 according to the invention. The table 100 has a round shape in its unexpanded configuration, as shown in FIG. 9A; however, its table top sections 102, 104 are of different sizes. Therefore, when the table 100 is in its expanded configuration, table leaves 106, 108 of different sizes, corresponding to the sizes of the gaps between the respective table top sections 102, may be inserted, giving the table 100 an oval shape in its expanded configuration, as shown in FIG. 9B.

Figure 10A:
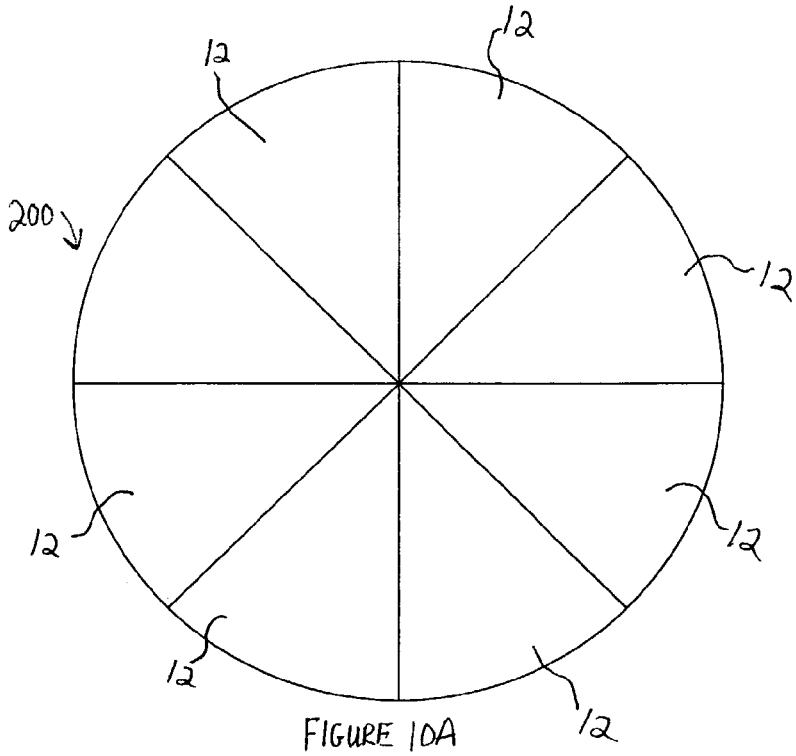
FIGS. 10A and 10B are schematic top plan views of a table according to yet another embodiment of the invention.
Figure 10B:
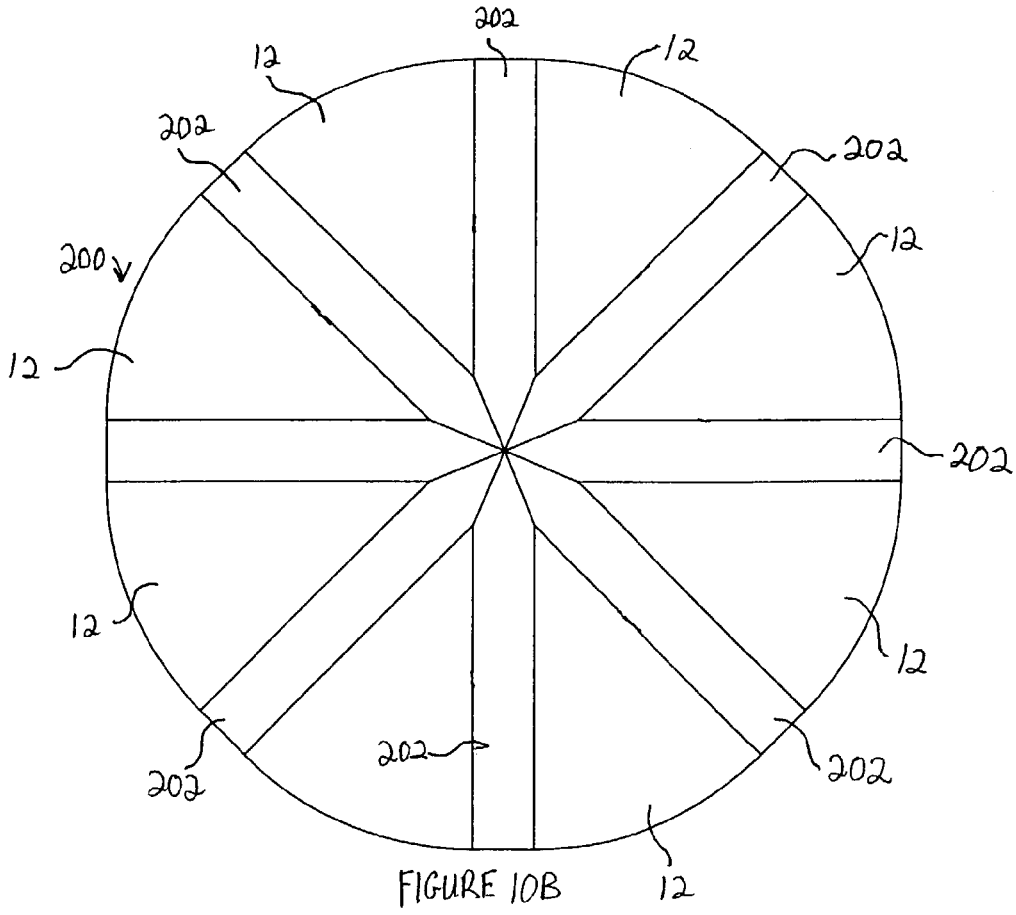

FIGS. 10A and 10B are schematic top plan views of another table 200 that is similar to the table 10 described above. The table 200 has a round shape in its closed configuration and table top sections 12 identical to those in the table 10, as shown in FIG. 10A. However, as shown in FIG. 10B, the table leaves 202 have straight, squared ends instead of rounded ends, giving the table 200 a semi-round shape in its expanded configuration.

Figure 11A:
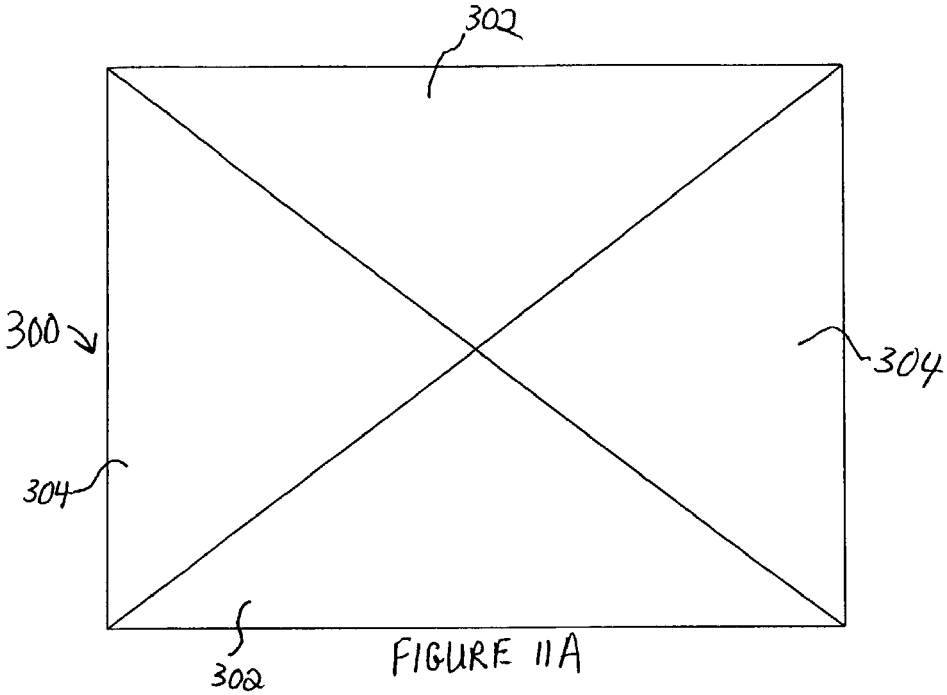
FIGS. 11A and 11B are schematic top plan views of a table according to a further embodiment of the invention.
Figure 11B:
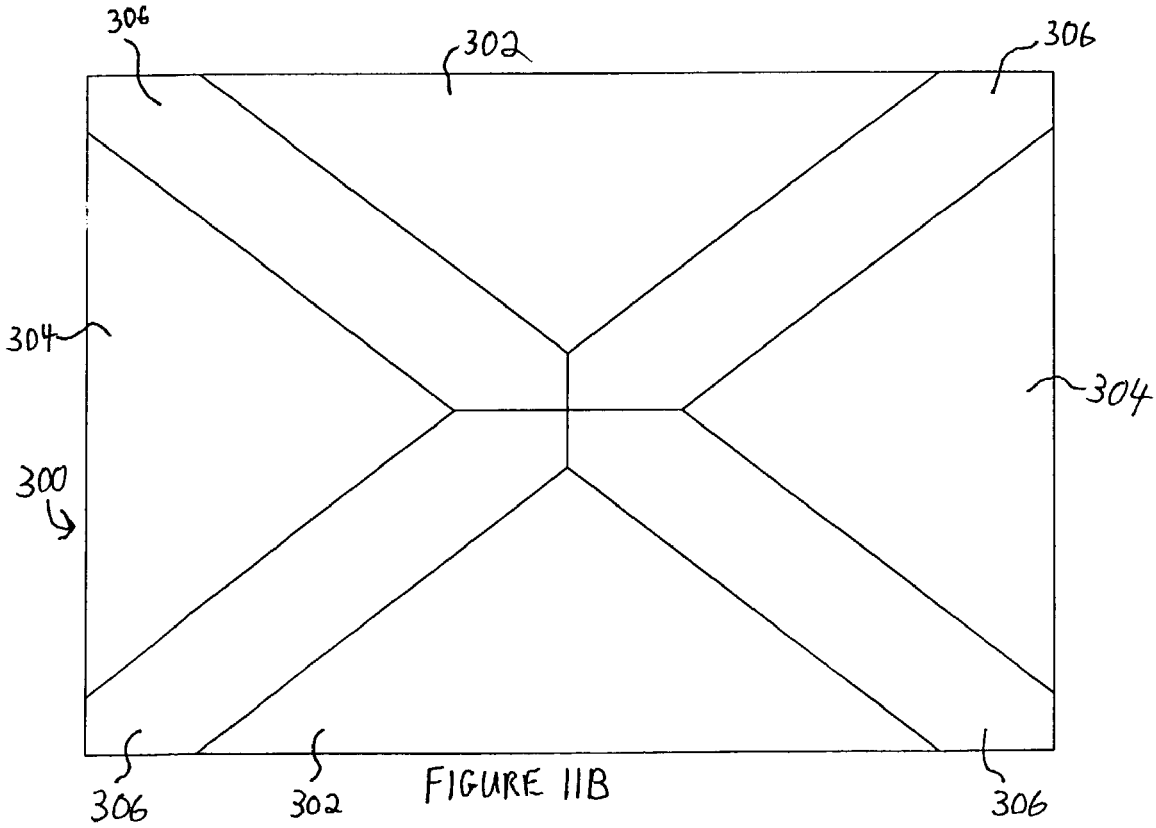

FIGS. 11A and 11B are schematic top plan views of a rectangular table 300 according to the principles of the invention. Each of the table top sections 302, 304 is substantially triangular in shape, as shown in FIG. 11A. In the expanded configuration, shown in FIG. 11B, the table leaves 306 of the table 300 are shaped to maintain the rectangular shape of the table 300. Additionally, the table top sections and table leaves of a table similar to table 300 may be shaped so as to form a square table top when the table top leaves are in their closed position and a rectangular table top with the leaves inserted.

One of ordinary skill in the art will be able to calculate the required shapes of the king pieces and brackets necessary for tables 100, 200, and 300 based on the number of table top sections and the geometry of each section.

While the invention has been described with respect to certain embodiments, modifications may be made within the scope of the invention. The scope of the invention is defined by the appended claims.

We claim:

1. An expandable table, comprising:

a pedestal;

a guide plate mounted on said pedestal;

a table top coupled to said guide plate over a top surface of said guide plate, said table top comprising a plurality of separate table top sections that are constructed and arranged to be movable relative to each other between positions defined by said guide plate; and a king piece mounted on said guide plate, said king piece having receiving structures constructed and arranged to receive projecting structures provided on respective inner edges of said table top sections, so that said table top sections are substantially contiguous when said table top sections are in a first position.

wherein said king piece is substantially cylindrical, and wherein said receiving structures are holes formed about the circumference of said king piece.

2. The expandable table of claim 1, wherein said king piece includes an upper row of holes and a lower row of holes.

3. The expandable table of claim 2, wherein said upper row of holes is angularly offset from said lower row of holes.

4. The expandable table of claim 3, wherein said projecting structures are provided on brackets secured to respective inner edges of said table top sections.

5. The expandable table of claim 4, wherein said table top sections are shaped as sectors of a circle, and said table top is a contiguous circle when said table top sections are in said first position.

6. The expandable table of claim 5, wherein said king piece is mounted on said guide plate so as to define the center of the table top.

7. The expandable table of claim 6, further comprising a plurality of table leaves, each table leaf being constructed and arranged to be removably mounted on said guide plate when said table top sections are in a second, outwardly expanded position.

8. The expandable table of claim 7, wherein said table leaves form a substantially contiguous table top with said table top sections when said table top sections are in said second position.

9. The expandable table of claim 8, wherein said table leaves include projecting structures provided on inner edges thereof, said projecting structures being constructed and arranged to engage one of the upper and lower rows of holes in said king piece.

10. The expandable table of claim 9, wherein each of said plurality of table leaves is constructed and arranged to be mounted between respective ones of said table sections to form said substantially contiguous table surface when said table sections are in said second position.

11. The expandable table of claim 2, wherein each hole of said upper and lower rows of holes has sloped wall portions.

12. An expandable table, comprising:

a pedestal;

a guide plate mounted on said pedestal, wherein said guide plate includes a plurality of guide slots formed therein;

a table top coupled to said guide plate over a top surface of said guide plate, said table top comprising a plurality of separate table top sections that are constructed and arranged to be movable relative to each other between positions defined by said guide plate;

a king piece mounted on said guide plate, said king piece having receiving structures constructed and arranged to receive projecting structures provided on respective inner edges of said table top sections, so that said table top sections are substantially contiguous when said table top sections are in a first position; and a plurality of guides, each of said guides being constructed and arranged to be slideably mounted within one of the guide slots in said guide plate, wherein said table top sections form a substantially contiguous table top when in a first position, and wherein each of said guide slots includes a spline mounted therein.

13. The expandable table of claim 12, wherein said spline is formed of a material selected from the group consisting of graphite and carbon fiber composite material, acetal plastic, high density polyethylene, ultra high molecular weight polyethylene, and ultra ultra high molecular weight polyethylene.

14. The expandable table of claim 13, wherein said spline includes a track constructed and arranged to slidingly engage projections provided on said guides.

15. The expandable table of claim 14, wherein each table top section is mounted on one of said guides.

16. An expanding table, comprising:

a pedestal;

a table top support coupled to said pedestal;

a plurality of rub blocks mounted on the table top support;

a table top disposed over said table top support; and a guide plate engaging said rub blocks with a downwardly-facing surface thereof for rotational movement with respect to said rub blocks wherein said table top comprises a plurality of separate table top sections that are constructed and arranged to be movable relative to each other in a radial direction.

17. The expandable table of claim 16, further comprising a king piece mounted on said guide plate, said king piece having receiving structures constructed and arranged to receive projecting structures provided on respective inner edges of said table top sections, so that said table top sections are substantially contiguous when said table top sections are in a first position.

18. The expandable table of claim 17, wherein said king piece is substantially cylindrical, and wherein said receiving structures are holes formed about the circumference of said king piece.

19. The expandable table of claim 18, wherein said king piece includes an upper row of holes and a lower row of holes.

20. The expandable table of claim 19, wherein each hole of said upper and lower rows of holes has sloped wall portions.

21. The expandable table of claim 20, wherein said upper row of holes is angularly offset from said lower row of holes.

22. The expandable table of claim 17, wherein said projecting structures are provided on brackets secured to respective inner edges of said table top sections.

23. The expandable table of claim 17, wherein said table top sections are shaped as sectors of a circle, and said table top is a contiguous circle when said table top sections are in said first position.

24. The expandable table of claim 23, wherein said king piece is mounted on said guide plate so as to define the center of the table top.

25. The expandable table of claim 24, further comprising a plurality of table leaves, each table leaf being constructed and arranged to be removably mounted on said guide plate when said table top sections are in a second, outwardly expanded position.

26. The expandable table of claim 25, wherein said table leaves form a substantially contiguous table top with said table top sections when said table top sections are in said second position.

27. The expandable table of claim 26, wherein said table leaves include projecting structures provided on inner edges thereof, said projecting structures being constructed and arranged to engage one of the upper and lower rows of holes in said king piece.

28. The expandable table of claim 27, wherein each table leaf of said plurality of table leaves is constructed and arranged to be mounted between respective table top sections of said plurality of table top sections to form said substantially contiguous table surface when said table top sections are in said second position.

29. The expandable table of claim 28, wherein said guide plate includes a plurality of guide slots formed therein.

30. The expandable table of claim 29, further comprising a plurality of guides, each of said guides being constructed and arranged to be slideably mounted within one of the guide slots in said guide plate.

31. The expandable table of claim 30, wherein each of said guide slots includes a spline mounted therein.

32. The expandable table of claim 31, wherein said splines are formed of a material selected from the group consisting of a graphite and carbon fiber composite material, acetal plastic, high density polyethylene, ultra high molecular weight polyethylene, and ultra ultra high molecular weight polyethylene.

33. The expandable table of claim 32, wherein said splines include tracks constructed and arranged to slidingly engage projections provided on said guides.

34. The expandable table of claim 30, wherein each table top section is mounted on one of said guides.

35. The expandable table of claim 25, wherein said table leaves have straight, squared outer edge portions.

36. The expandable table of claim 17, wherein the rub blocks are comprised of acetal plastic.

37. The expandable table of claim 17, wherein the rub blocks are comprised of a material selected from the group consisting of high density polyethylene plastic, ultra high density polyethylene plastic, and ultra ultra high density polyethylene plastic.

38. The expandable table of claim 17, wherein said table top is a contiguous rectangle when said table top sections are in said first position.

39. An expandable table, comprising:

a pedestal;

a table support structure mounted to said pedestal and extending outwardly therefrom;

a plurality of arcuate rotating members mounted on said support structure;

a guide plate movably mounted on said pedestal and having a plurality of slots therein, each arcuate rotating member at least partially received in the slots of said guide plate;

a plurality of guides, each of said plurality of guides being at least partially received in one of the slots of said guide plate, each of said plurality of guides being mounted on one of said plurality of arcuate rotating members; and a table top comprising a plurality of table top sections, each table top section of said plurality of table top sections being mounted on a corresponding guide of said plurality of guides such that said table top sections are movable relative to one another in a radial direction.

40. The expandable table of claim 39, further comprising a king piece mounted on said guide plate, said king piece having receiving structures constructed and arranged to receive projecting structures provided on respective inner edges of said table top sections so that said table top sections are substantially contiguous when said table top sections are in a first position.

41. The expandable table of claim 40, further comprising a plurality of table leaves, each of said plurality of table leaves being constructed and arranged to be removably mounted on said guide plate when said table top sections are in a second, outwardly expanded position.

42. The expandable table of claim 41, wherein each of said plurality of table leaves includes a projecting structure on an inner edge thereof, said projecting structure being constructed and arranged to be received by said king piece when said plurality of table leaves is mounted on said guide plate.

43. An expandable table, comprising:

a pedestal;

a guide plate movably coupled to said pedestal, said guide plate having a plurality of slots;

a plurality of guides, each being disposed in a slot of the plurality of slots of said guide plate;

a table top comprising a plurality of table top sections, each table top section having a tongue and groove structure constructed and arranged to engage a tongue and groove structure of an adjacent table top section, each of said plurality of table top sections being mounted on a corresponding one of said plurality of guides so as to be movable relative to each other in a radial direction; and a king piece mounted on said guide plate, said king piece having receiving structures constructed and arranged to receive projecting structures provided on respective inner edges of said table top sections so that said table top sections are substantially contiguous when said table top sections are in a first position.

44. The expandable table of claim 43, further comprising a plurality of table leaves, each of said plurality of table leaves being constructed and arranged to be removably mounted on said guide plate when said table top sections are in a second, outwardly expanded position.

45. The expandable table of claim 44, wherein each of said plurality of table leaves includes a projecting structure on an inner edge thereof, said projecting structure being constructed and arranged to be received by said king piece when said plurality of table leaves is mounted on said guide plate.

46. An expandable table, comprising:

a pedestal;

a table support structure mounted on said pedestal and extending outwardly therefrom;

a plurality of arcuate rotating members mounted on said table support structure;

a guide plate mounted on said pedestal, said guide plate having a plurality of slots therein, each of said plurality of slots at least partially receiving an end of one of said plurality of arcuate rotating members;

a table top comprising a plurality of table top sections disposed over said guide plate, each of said plurality of table top sections being coupled to the end of one of said plurality of arcuate rotating members, the table top sections being constructed and arranged to be movable relative to each other in a radial direction.

47. The expandable table of claim 46, further comprising a king piece mounted on said guide plate, said king piece having receiving structures constructed and arranged to receive projecting structures provided on respective inner edges of said table top sections, so that said table top sections are substantially contiguous when said table top sections are in a first position.

48. The expandable table of claim 47, further comprising a plurality of table leaves, each of said plurality of table leaves being constructed and arranged to be removably mounted on said guide plate when said table top sections are in a second, outwardly expanded position.

49. The expandable table of claim 48, wherein each of said plurality of table leaves includes a projecting structure on an inner edge thereof, said projecting structure being constructed and arranged to be received by said king piece when said plurality of table leaves is mounted on said guide plate.

* * * * *